US007053597B2

(12) United States Patent
Lin et al.

(10) Patent No.: US 7,053,597 B2
(45) Date of Patent: May 30, 2006

(54) REGULATOR AND RELATED CONTROL METHOD FOR PREVENTING EXCEEDING INITIAL CURRENT BY COMPENSATION CURRENT OF ADDITIONAL CURRENT MIRROR

(75) Inventors: Peter Lin, Hsin-Tien (TW); Arioso Lin, Hsin-Tien (TW)

(73) Assignee: Via Technologies Inc., Hsin-Tien (TW)

( * ) Notice: Subject to any disclaimer, the term of this patent is extended or adjusted under 35 U.S.C. 154(b) by 244 days.

(21) Appl. No.: 10/610,639

(22) Filed: Jul. 2, 2003

(65) Prior Publication Data

US 2004/0145362 A1 Jul. 29, 2004

(30) Foreign Application Priority Data

Jan. 23, 2003 (TW) ..... 92101529 A

(51) Int. Cl.
*G05F 3/16* (2006.01)

(52) U.S. Cl. ..... 323/316; 323/280

(58) Field of Classification Search ..... 323/312, 323/313, 314, 315, 316, 238, 280, 281, 242, 323/288

See application file for complete search history.

(56) References Cited

U.S. PATENT DOCUMENTS 4,740,742 A * 4/1988 Gontowski, Jr. ..... 323/313
6,617,833 B1 * 9/2003 Xi ..... 323/282

* cited by examiner

*Primary Examiner*—Jessica Han
(74) *Attorney, Agent, or Firm*—Winston Hsu

(57) ABSTRACT

A regulator and a related control method for providing a regulated voltage. The regulator includes a bipolar junction transistor (BJT), a capacitive module having capacitors, and an operational amplifier (OP-AMP) for feedback control. The OP-AMP has a amplifying circuit, a driving stage and a current mirror. The BJT charges the capacitive module to establish the regulated voltage, the OP-AMP controls a driving current of a base of the BJT according to the feedback of the regulated voltage. When the regulated voltage is in a predetermined range, the current mirror provides a secondary current through the driving stage such that the driving current is reduced, and the current of the BJT is thus limited to its rated current. When the regulated voltage is out of the predetermined range, the current mirror stops providing the secondary current, and the regulator will operate normally without current supplied by the current mirror.

13 Claims, 5 Drawing Sheets

REGULATOR AND RELATED CONTROL METHOD FOR PREVENTING EXCEEDING INITIAL CURRENT BY COMPENSATION CURRENT OF ADDITIONAL CURRENT MIRROR

CROSS REFERENCE TO RELATED APPLICATIONS

BACKGROUND OF INVENTION

1. Field of the Invention

The present invention relates to a regulator and a related control method, and more particularly, to a regulator and a related control method for preventing exceeding initial current by a secondary current of an additional current mirror.

2. Description of the Prior Art

Currently, microcontrollers are essential to electronic products such as cellular phones, computers, and servers. How to make microcontrollers operate effectively becomes one of the most important topics to researchers and developers.

In order to optimize the volume density of elements, the power consumption and the operation speed of microcontroller semiconductor circuits, the driving voltage of the core circuit in the chip and the voltage of the corresponding signal are usually lower than those of common circuits. Hence, an I/O buffer for signal translation between different voltages is needed. FIG. 1 is a block diagram of a conventional chip 10 and a related circuit board 12. For example, the circuit board 12 is a motherboard of a personal computer and the chip 10 is a related controlling chip such as North/South Bridge Chip. In another example, the circuit board 12 is an add-on card such as an Ethernet Card and the chip 10 is a related controlling chip. The chip 10 contains a core circuit 14 and an I/O circuit 16. Processed signals from the core circuit 14 to the circuit board 12 or signals to be processed from the circuit board 12 to the core circuit 14 should go through the I/O circuit 16 where the signals are buffered and transformed. As mentioned before, the core circuit 14 is biased by a lower voltage and the voltage of all the processed signals are lower than that of the circuit board 12. In order to transmit the signals from the core circuit 14 to the circuit board 12, the circuit 16 increases the voltage and the power of the related signals. In order to transmit the signals from the circuit board 12 to the core circuit 14, the circuit 16 decreases the voltage and the power of the related signals.

As the I/O circuit 16 and the circuit board 12 are designed to exchange data directly, they are usually biased by the same voltage. In FIG. 1 the DC voltage Vcc, Vss (Vss is typically ground voltage) are applied for biasing the circuit board 12 and the core circuit 16 in the chip 10. As mentioned before, the core circuit is biased by a lower voltage and the chip 10 should include a regulator 18 in order to provide a regulated voltage Vp25 for biasing the core circuit 14. Typically, the circuit board 12 can provide a DC voltage of 3.3V for the chip 10 and the core circuit 14 is biased by a lower voltage 2.5V. In such a case, the regulator should utilize the DC voltage of 3.3V to produce the DC voltage of 2.5V in order to meet the electrical requirement of the core circuit 14. In the chip 10 there is a detection circuit 26 electrically connected with the node Np0 that checks if the regulated voltage is generated and sends a detection signal Vpg0 to indicate the detection result.

As FIG. 1 shows, conventionally the regulator 18 utilizes a pnp-type bipolar junction transistor Qp1 on the circuit board 12 for circuit charging and a capacitive module 24 containing a capacitor Cp1 of high capacitance on the circuit board 12 and a capacitor Cp2 for bypassing. Adapting to the transistor Qp1 and the capacitive module 24 on the circuit board 12, the chip 10 contains an operational amplifier 20, a band-gap circuit 22, and a voltage divider including two resistors Rp0, Rp1. The regulator 18 is biased by the DC voltage difference between Vcc and Vss. The band-gap circuit 22 provides a reference voltage Vbg0. The operational amplifier 20 has differential input ends Inn0, Inp0 electrically connected with the node Np1 and the band-gap circuit 22 individually, and its output end Op0 is connected with the base of the transistor Qp1 to control the driving voltage Vd0 and the driving current Ib0. The chip 10 may have a pin as the connection between the output Op0 and the transistor Qp1 on the circuit board 12. The emitter of the transistor Qp1 is biased at the DC voltage Vcc and the node Np0 is electrically connected with the capacitive module 24. The capacitive module 24 has a capacitor Cp1 of high capacitance to regulate its output voltage and a capacitor Cp2 for bypassing AC interference. When the capacitor is charged and reaches a steady state, a regulated voltage Vp25 is established at the node Np0. The regulated voltage Vp25 of the capacitive module 24 at the node Np0 is applied back to the chip 10 via another pin. The regulated voltage Vp25 is applied to the core circuit 14 as a DC bias voltage; meanwhile, at the node Np1 a divided voltage Vs0 is established via the voltage divider, the resistors Rp0, Rp1. The operational amplifier 20 compares the reference voltage Vbg0 with the voltage Vs0, and then sends a feedback signal to the transistor Qp1 to control the driving voltage Vd0 and the driving current Id0. Moreover, while the chip 10 is not operated, the circuit board 12 need not to provide the DC voltage Vcc for biasing the chip 10 and the regulator 18 is idle. Hence, the voltage of the node Np0 is equivalent to the lower DC voltage Vss.

The following relates the operation of the regulator 18. The circuit board 12 enables the chip 10 with the DC voltage Vcc applied to the regulator 18. The band-gap circuit 22 and the operational amplifier 20 start functioning and the operational amplifier 20 starts to compare Vs0, the voltage of Np1, with Vbg0, the reference voltage generated by the band-gap circuit. As the voltage of the node Np0 and the voltage Vs0 stay low before the regulator 18 starts functioning, the voltage Vd0 of the output end Op0 of the operational amplifier 20 correspondingly stays low due to the fact that the voltage Vs0 is much smaller than the reference voltage Vbg0 when the operational amplifier 20 starts functioning. The voltage difference between the emitter and the base of the transistor Qp1 is almost the same as the voltage difference between the DC voltages Vcc, Vss. And, the operational amplifier 20 functions as a current sink obtaining driving current Ib0 from the base of the transistor Qp1 to drive it, enabling the large current Ic0 between the emitter and the collector to affect the capacitive module 24, such as to charge the high capacitance capacitor Cp1 in the capacitive module 24. As known by those skilled in the art, through the current driving characteristic of the bipolar junction transistor and the driving current Ib0 obtained from the base of the transistor Qp1 by the operational amplifier 20, the operational amplifier 20 can drive and control the current Ic0 between the emitter and the collector of the transistor Qp1 according to $Ic0=\beta*Ib0$, where $\beta$ is the current magnification of the bipolar junction transistor.

As the charging process continues, the voltage of the node Np0 increases, and Vs0, the voltage of the node Np1, increases gradually. Correspondingly at the output Op0 of the operational amplifier 20, the driving voltage Vd0 increases and the driving current Ib0 decreases so that the voltage difference between the emitter and the base of the transistor Qp1 decreases with a low degree of turning on, and the current Ic0 decreases gradually. Through the feedback of the voltage Vs0, the operational amplifier 20 can control the driving voltage Vd0 and the voltage Vp25 at the node Np0 will approach a constant value of a steady state. When the steady state approaches, the operational amplifier 20 makes the voltage Vs0 equivalent to the reference voltage Vbg0. That is, the voltage Vp25 equals (1+Rp0/Rp1)Vbg0. The regulated voltage Vp25 may be applied to the core circuit 14 to bias it, and the current Ic1, which the core circuit 14 needs while operating, is supplied by the transistor Qp1. When the voltage V25 fluctuates, the operational amplifier 20 will correspondingly control the driving voltage Vd0 and the driving current Ib0 for dynamic compensation. For example, if the current loading of the core circuit 14 increases for a large amount of calculation, the capacitor Cp1 will prevent the voltage Vp25 at the node Np0 from decreasing rapidly. In addition, the voltage decrease of Vs0, the decrease of the driving voltage Vd0, the increase of the voltage between the emitter and the base of the transistor Qp1 are induced correspondingly for the slight voltage decrease of Vp25 so that the current Ic0 of the transistor Qp1 is increased to meet the requirement of the core circuit 14. Besides, as mentioned above, the chip 10 has the detection circuit 26 to detect if the regulated voltage Vp25 is established normally. In this establishing process, when the regulated voltage Vp25 of the regulator 18 just increases gradually from a low level, the voltage Vgp0 generated by the detection circuit 26 stays at a low level representing a digital "0" meaning that the regulated voltage Vp25 has not been established. When the regulated voltage Vp25 reach a predetermined voltage, (e.g. 90% of the regulated voltage in the steady state), the voltage Vgp0 generated by the detection circuit 26 switches to a high level representing a digital "1" meaning that the regulated voltage Vp25 has been established, i.e. power-good. The I/O circuit 16 and the core circuit 14 shall cooperate to make the chip 10 functional, but the I/O circuit 16 is biased at the voltage Vcc prior to the establishment of the regulated voltage Vp25 for biasing the core circuit 14. In order to coordinate, the I/O circuit 15 and the core circuit 14 will reset at the same time when the digital "1" of the voltage Vgp0 of the detection circuit 26 is generated.

Please refer to FIG. 2 illustrating the function of the operational amplifier 20 of FIG. 1 during the establishment of the regulated voltage Vp25. The operational amplifier 20, which is biased by the voltage difference between Vcc and Vss, comprises NMOS transistors M1~M8 and PMOS transistors M9~M14 to form an amplifying circuit 29 and a driving stage 28 of class AB output. The driving stage 28 is formed with transistors M8, M14 and the amplifying circuit 29 is formed with the other transistors. The substrates of NMOS transistors M1~M8 are biased at Vss and those of PMOS transistors M9~M14 are biased at Vcc. The transistors M1, M2 form a differential pair and having gates forming the input ends Inp0, Inn0 respectively. The gates of the transistors M3~M6 are electrically connected forming a current mirror, through which a support circuit 27 providing a reference current Ir0 can apply the bias to the amplifying circuit 29. For example, the transistor M4 electrically connected with the node Np3 is the current source to bias the differential pair formed with the transistors M1, M2. To summarize, the transistors M1, M2, M9, M10 functioning as differential pairs send the signals to the transistors M7, M3, M12, M13 functioning as the buffer. The output voltages of the amplifying circuit 29 at the nodes Np5, Np6 will individually control the gate voltages of the transistors M8, M14 of the driving stage 28, of which the node Np4 is the output end Op0 of the operational amplifier 20, referring back to FIG. 1.

As mentioned above, conventionally when the regulator 18 start functioning, it will obtain a certain amount of current Ib0 from the base of the transistor Qp1 to turn on the large charging current Ic0 of the transistor Qp1, as shown in FIG. 1.

In FIG. 2 the circuit diagram shows the conventional structure of the operational amplifier 20. When the regulator 18 starts functioning, the regulated voltage Vp25 of the node Np0, referring to FIG. 1, is almost the same as the DC voltage Vss, which is of a lower level, so the divided voltage Vs0 at the node Np1 is also of a lower level, and consequently, so is that of the input end Inp0 of the operational amplifier 20. Compared with the reference voltage Vbg0 (typically between 1~2 Volts) of a higher level at the input end Inn0, the voltage of a lower level at the input end Inp0 nearly turns off the transistor M1 as shown in FIG. 2. The current provided by the transistor M4 is mainly conducted by the transistor M2 so the gate voltage of the transistor M7 is pulled to a voltage Vcc of a high level and the voltages at the node Np5, Np6 are consequently pulled high. Such situation turns off the transistor M14 and makes the current Id0 of the transistor M8 high, the current Id0 being the driving current Ib0 obtained from the base of the transistor Qp1 by the operational amplifier 20 via its input end Op. Then, the driving current Ib0 will turn on the transistor Qp1 to provide the large charging current Ic0. That is, the base of the transistor Qp1 is regarded as a control end and the node Np4 is regarded as a control node, through which the driving current Ib0 determines the driving status of the transistor Qp1. The degree of current flowing between the drain and the source of the transistor M8 determines the current flowing from the node Np4 and consequently controls the charging current Ic0 provided by the transistor Qp1.

Conventionally, the regulator 18 in FIG. 1 can generate the regulated voltage Vp25 to bias the core circuit 14. Of concern is the regulator 18 initially overdriving the transistor Qp1 and burning it out due to an overly large current. As mentioned above, when the regulator 18 start functioning, the low voltage at the node Np0 makes the driving voltage Vd0 low at the output end Op0 of the operational amplifier 20. Accordingly the voltage difference between the emitter and the base of the transistor Qp1 is almost the same as that between DC voltages Vcc, Vss, and the NMOS transistor M8 of the driving stage 28 of the operational amplifier 20 turns on the driving current Ib0 driving the transistor Qp1 and turns on the large current Ic0 in the transistor Qp1. According to the typical case mentioned above, the voltage difference between DC voltages Vcc, Vss is 3.3 Volts, but the voltage difference needed for operation between the emitter and the base of the transistor Qp1 is only 0.7~0.8 Volts. As a result, the initial turned-on current of the transistor Qp1 is much larger than what is needed in normal operation. Such a large current burns the transistor Qp1 out in the beginning of the operation of the regulator 18. Therefore, the regulator 18 cannot function well to provide the regulated voltage Vp25 to bias the chip 10, and the microcontroller fails to function.

SUMMARY OF INVENTION

It is therefore a primary objective of the claimed invention to provide a regulator and a related control method for preventing exceeding an initial driving current of the base of the bipolar junction transistor by a secondary current of an additional current mirror, to solve the above-mentioned problems.

In the prior art, the conventional regulator turns on the transistor of the driving stage of the operational amplifier according to the regulated voltage, which is low at the beginning of the operation of the regulator, so the conventional operational amplifier obtains larger driving current from the bipolar junction transistor. Accordingly, the bipolar junction transistor is overdriven and burned out by the excessive charging current, and the regulated voltage to bias the core circuit of the chip is not available.

According to the claimed invention, the regulator provides an additional secondary current of an additional current mirror at the beginning of the operation. Even when the operational amplifier of the claimed invention turns on the transistor of the driving stage according to a regulated voltage that is low at the beginning, the secondary current will flow into the turned-on transistor to effectively decrease the net current obtained from the base of the bipolar junction transistor. Therefore, the bipolar junction transistor will not be overdriven and the correct regulated voltage is available for biasing the chip.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
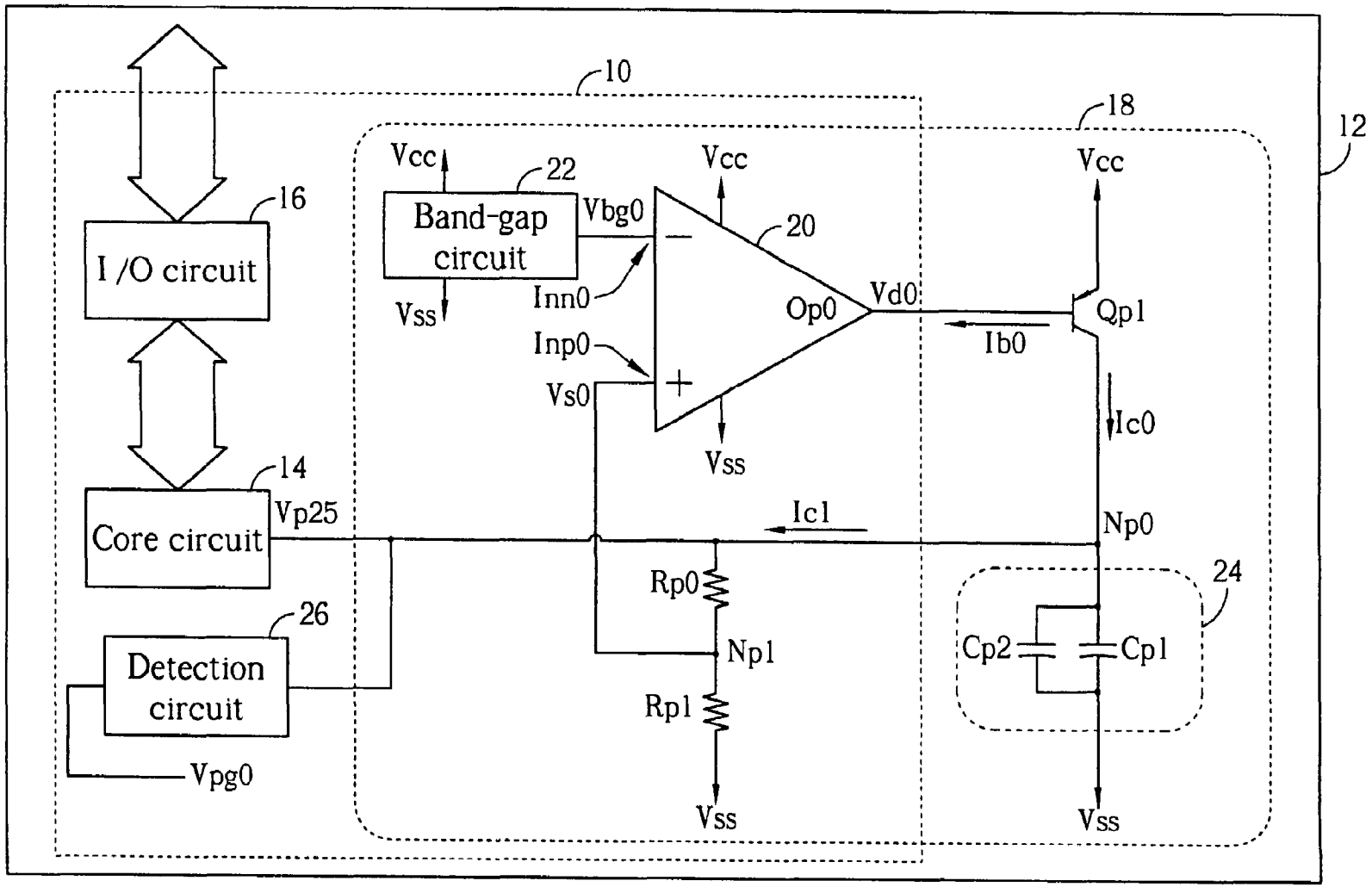
Fig. 1 Prior art
FIG. 1 is a block diagram of a regulator installed in a chip and in a circuit board according to the prior art.
Figure 2:
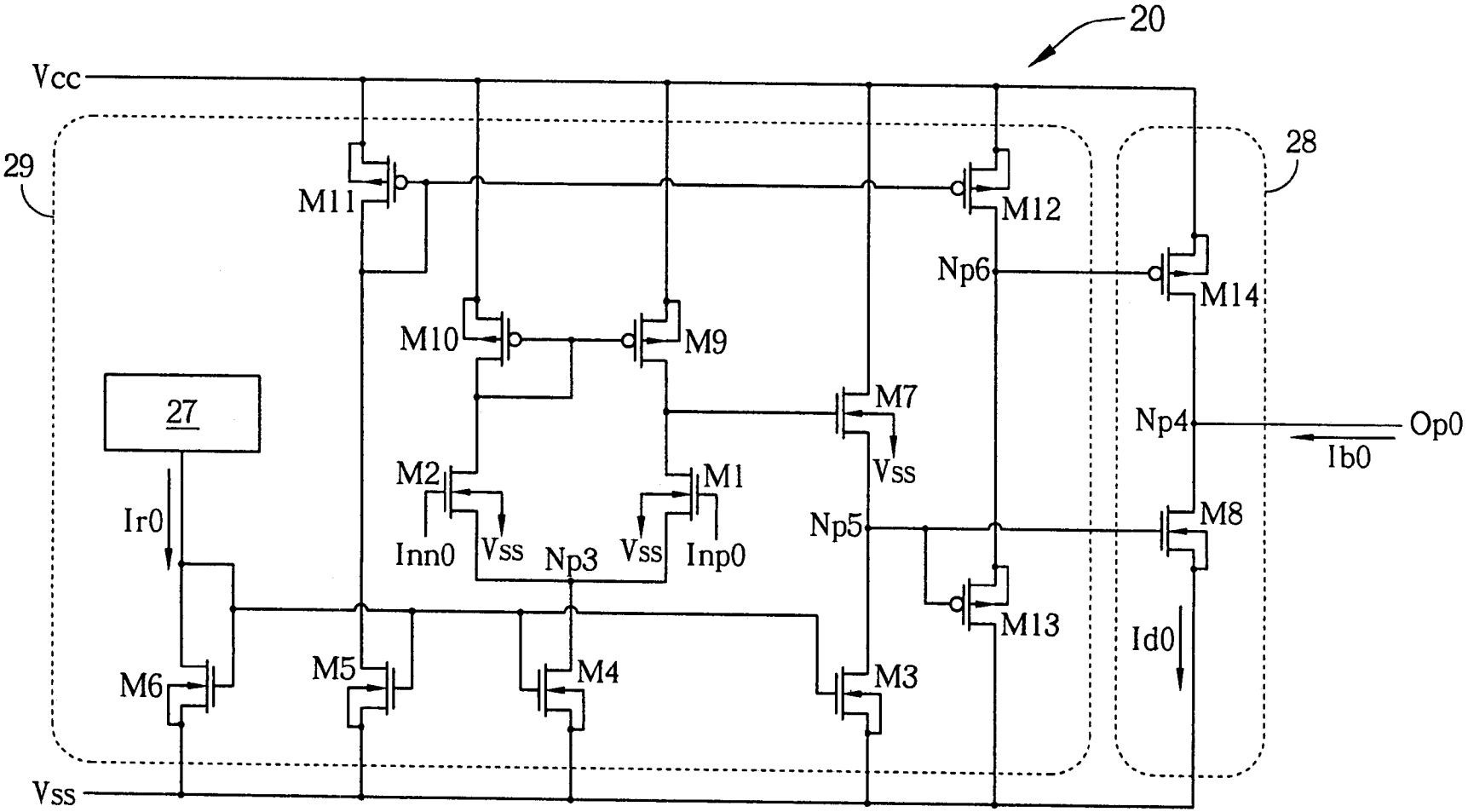
Fig. 2 Prior art
FIG. 2 is a circuit diagram of the operational amplifier of FIG. 1.
Figure 3:
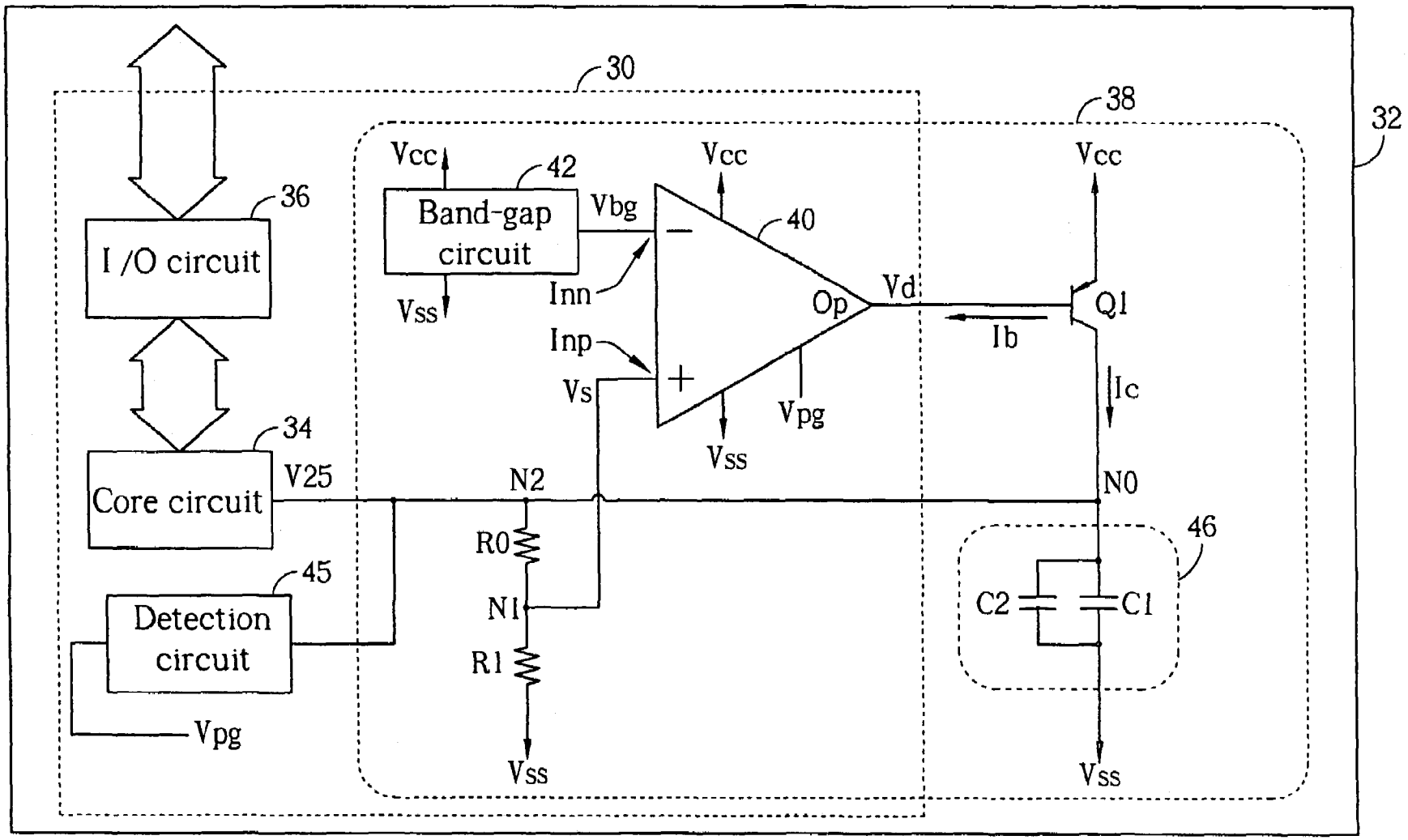
FIG. 3 is a block diagram of a regulator installed in a chip and in a circuit board according to the present invention.

Please refer to FIG. 3. FIG. 3 is a block diagram of a regulator 38 installed in a chip 30 of a circuit board 32 according to the present invention. According to the setup of modern microcontrollers, the chip 30 is installed with a core circuit 34 and an I/O circuit 36. The core circuit 34 is biased by regulated voltage V25 of a lower level to process the signals and calculate the data. The I/O circuit 36 and the circuit board 32 are biased by a DC voltage Vcc of a higher level to transmit the data and signals exchanged between the core circuit 34 and the circuit board 32. The DC bias Vss is grounded. In order to provide the regulated voltage V25 for the core circuit 34, in the present invention there is a regulator 38 installed between the chip 30 and the circuit board 32 to establish the regulated voltage V25 utilizing the DC bias Vcc. The regulator 38 in the present invention is biased by the voltage difference between the DC voltages Vcc, Vss (for example, Vcc=3.3V, Vss=0V), and includes a band-gap circuit 42 in the chip 30, an operational amplifier 40, and a voltage divider containing two resistors R0, R1. Adapting the circuit mentioned above, the circuit board 32 is installed with a pnp-type bipolar junction transistor Q1 as a charging circuit and a capacitive module 46. The band-gap circuit 42 generates a reference voltage Vbg0. The operational amplifier 40 is installed with two differential input ends Inp, Inn and an output end Op. The input end Inn is applied with the reference voltage Vbg and the input end Inp is electrically connected with the node N1. When the operational amplifier 40 is operating, it sends a corresponding driving voltage Vd and a driving current Ib from the output end Op to drive the transistor Q1 according to the voltage difference between the two input ends Inp, Inn. As a charging circuit, the base of the transistor Q1 is driven by the driving voltage Vd and the driving current Ib output by the operational amplifier 40 (the chip 30 is installed with a pin through which the output end Op is electrically connected with the base of the transistor Q1). The emitter is biased by the DC voltage Vcc, and the collector is electrically connected with the node N0. According to the driving current Ib, the transistor Q1 provides a charging current Ic flowing into the node N0 due to the driving characteristic of the bipolar junction transistor. The capacitive module 46 is installed with a capacitor C1 of high capacitance and a capacitor C2 for bypassing. The capacitor module 46 can regulate the voltage and bypass the AC interference to establish a constant voltage at the node N0. With the load of the capacitive module 46, the regulator 38 establishes the regulated voltage V25. Through another pin of the chip 38 the node N0 is electrically connected with the node N2 in the chip 30 to apply the regulated voltage V25 to the core circuit 34 and bias it. At the same time, the voltage divider comprising the resistors R0, R1 provides the voltage Vs at the node N1 utilizing the regulated voltage V25, and outputs the voltage Vs, which is equal to the voltage (R1/(R1+R2))V25, to the input end Inp of the operational amplifier 40. In addition, the chip 30 is installed with a detection circuit 45 to detect if the regulated voltage V25 is established and correspondingly output the voltage Vpg as a detection signal. Before the desired regulated voltage V25 is established, the voltage Vpg output by the detection circuit 45 stays low. After the regulated voltage V25 increases and reaches a predetermined value (such as 90% of the regulated voltage in a steady state), the voltage Vpg is pulled high representing that the regulated voltage V25 is able to provide the regulated voltage for the core circuit 34 and bias it.

Figure 4:
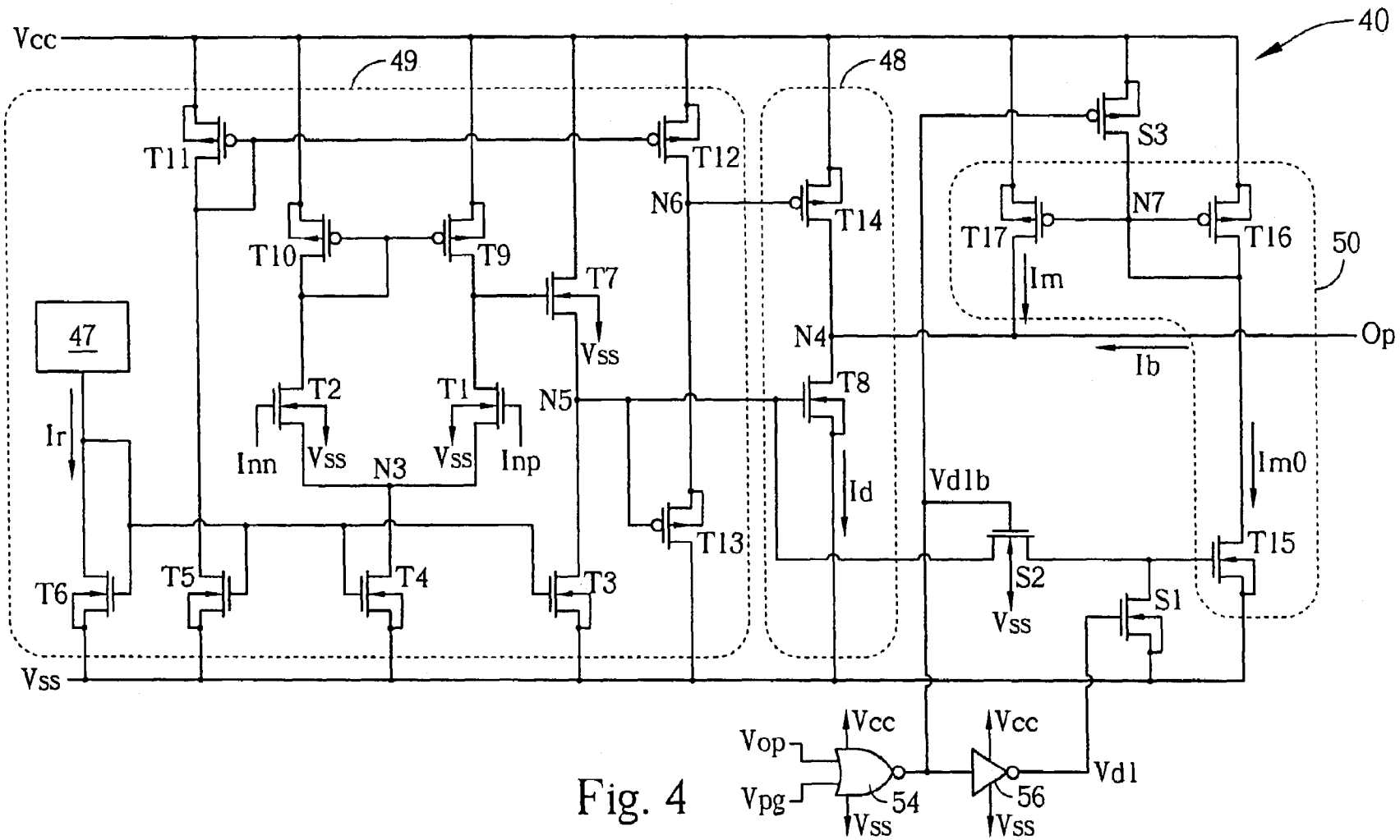
FIG. 4 is a circuit diagram of the operational amplifier of FIG. 3.

In one of the preferred embodiments of the present invention, the operational amplifier 40 in the present invention further switches between different modes according to the voltage Vpg output by the detection circuit 45. FIG. 4 is a circuit diagram of the operational amplifier 40 of the present invention. The operational amplifier 40 is installed with an amplifying circuit 49, a driving stage 48, and an additional current mirror 50. The amplifying circuit 49 comprises NMOS transistors T1~T7, PMOS transistors T9~T13. The driving stage 48 comprises an NMOS transistor T8 and a PMOS transistor T14. The current mirror 50 comprises an NMOS transistor T15 and PMOS transistors T16, T17. NMOS transistors S1, S2 and a PMOS transistor S3 are switching transistors for controlling the operation of the current mirror 50 according to the voltage Vpg output from the detection circuit 45 (and optionally according to another controlling voltage Vop). The gates of the transistors S2, S3 and the gate of the transistor S1 are respectively controlled by the output voltage Vd1*b* of the NOR gate 54 and the output voltage Vd1 of the inverter 56. The substrates of the PMOS transistors are biased by the DC voltage Vcc and the substrates of the NMOS transistors are biased by the DC voltage Vss. The NOR gate 54 and the inverter 56 are also biased between the DC voltages Vcc, Vss.

In the amplifying circuit 49, the transistors T1, T2 form a differential pair having gates as input ends Inp, Inn respectively of the operational amplifier 40. The transistors T9, T10 are regarded as active loads of the transistors T1, T2. The gates of the transistors T3~T6 are electrically connected to form another current mirror, in which the turned-on currents of the transistors are controlled by the transistor T6 according to the reference current Ir provided by a support circuit 47. The transistor T4 electrically connected with the node N3 is a current source to provide the driving current for the differential pair. In summary, the transistors T1, T2, T9, T10 form a differential input stage whose output signals are buffered by the transistors T7, T3, T12, T13, and then output to the driving stage 48 through the nodes N5, N6. The transistors T8, T14 in the driving stage 48 form a class AB output stage receiving the signals from the nodes N5, N6, which are the gates of the two transistors, and outputting the final amplified signal to the node N4, which is the output end of the operational amplifier 40.

In the current mirror 50 of the present invention, the gate of the transistor T15 is electrically connected through the transistor S2 with the node N5, and to the gate of the transistor T8 in the driving stage 48. The gates of the transistors T16, T17 are both electrically connected with the node N7. As shown in FIG. 4, when the voltage Vd1*b* of the NOR gate 54 is of a high level (the voltage level of the DC voltage Vcc) and the voltage Vd1 is of a low level (the voltage level of the DC voltage Vss), the switching transistors S3, S1 are turned off, and the transistor S2 turns on the electrical connection between the gates of the transistors T8, T15 to make the transistors T8, T15, T16, T17 form a current mirror. The transistor T15 turns on a current Im0 according to the current Id turned on by the transistor T8. Through the setup of the gate coupling of the transistors T16, T17, the transistor T17 turns on a current Im that flows into the node N4 according to the degree of current flowing in the transistor T16. Being obtained by the operational amplifier 40 from the base of the transistor Q1 (also referring to FIG. 3), the driving current Ib flows into the node N4 together with the current Im. When the voltage Vd1*b* of the NOR gate 54 is of a low level and the voltage Vd1 is of a high level, the transistors S3, S1 are turned on, and the transistor S2 is turned off to disable the control of the node voltage of the node N5 over the gate of the transistor T15 and enable an electrical connection between the gate of the transistor T15 and the DC voltage Vss to turn off the transistor T15. Accordingly, the gate voltage of the transistors T16, T17 at the node N7 is pulled to the DC voltage Vcc of the higher level via the electrical connection established by the turned-on transistor S3, so the transistors T16, T17 are turned off and the transistor T17 disables the current Im flowing into the node N4. To summarize, through the voltages Vpgand the related output voltage Vd1*b* (that is, Vd1) of the NOR gate (and optionally through Vop), the current mirror 50 providing the current Im flowing into the node N4 can be controlled according to the degree of current flowing in the transistor T8.

Figure 5:
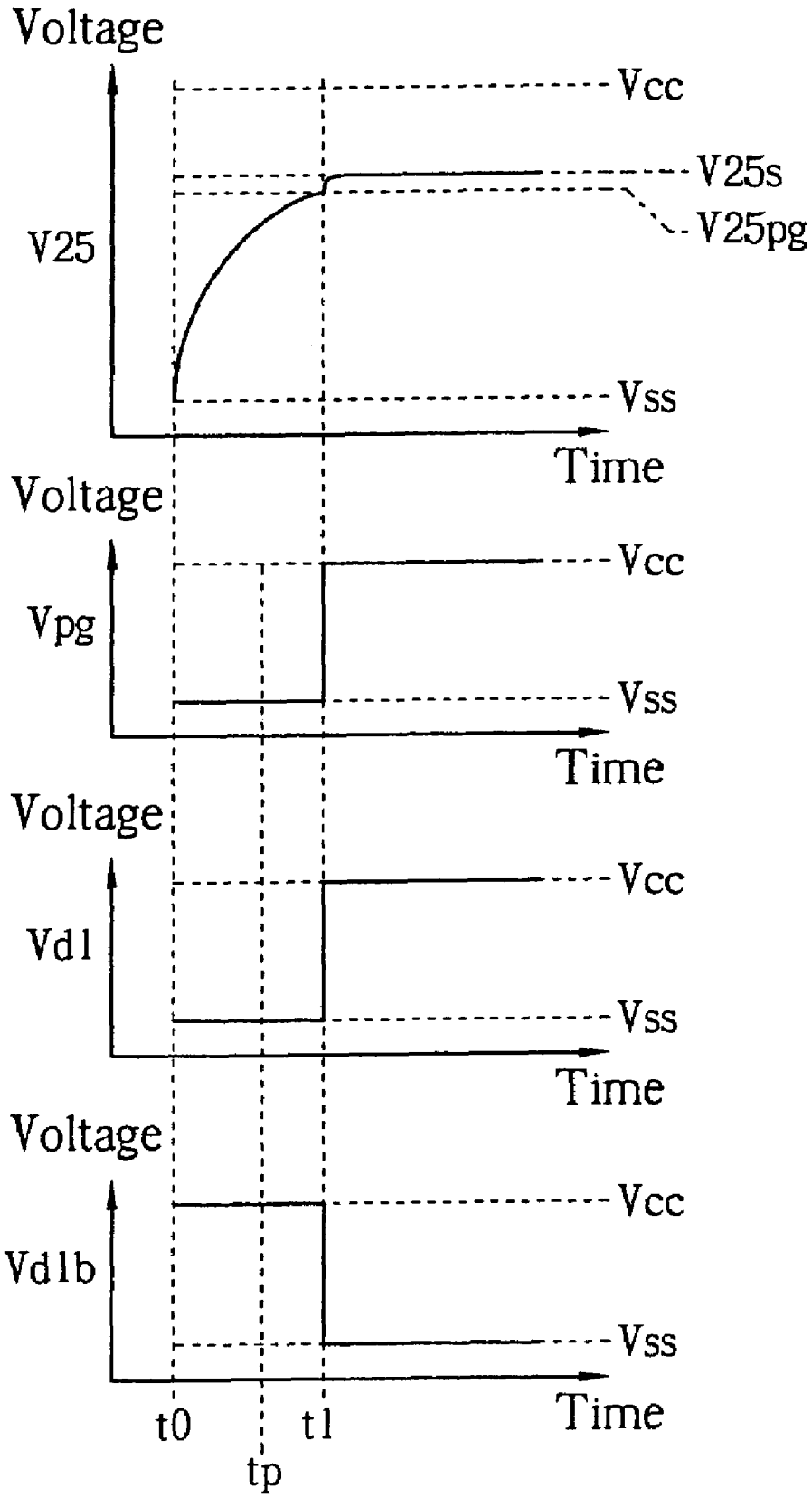
FIG. 5 is a diagram of related signals, waveforms, and time sequences while the regulator of FIG. 3 is operating.

Please refer to FIG. 5 together with FIG. 3 and FIG. 4. FIG. 5 is a diagram of related signals, waveforms, and time sequences while the regulator 38 of the present invention in FIG. 3 is operating. In FIG. 5, from top to bottom, the waveforms drawn with solid-lines represent the regulated voltage V25, the voltage Vpg of the detection circuit 45, and the voltages Vd1, Vd1*b* (referring to FIG. 4). The horizontal axis denotes the time, and the vertical axis denotes the voltage amplitude. Referring to FIG. 5 together with FIG. 3, FIG. 4, the conception and embodiment of the present invention will be explained in the following. Suppose the circuit board 32 starts operating and provides the DC voltage Vcc at time t0. At time t0, the capacitor C1 in the capacitive module 46 has not been charged, the voltage of the node N2 is close to a low level (the voltage level of the DC voltage Vss), and correspondingly the voltage Vs of the node N1 stays low. At the same time, the band-gap circuit 42 is biased by the DC voltage Vcc and then generates the reference voltage Vbg (typically between 1~2V). Therefore, in the operational amplifier 40 the transistor T2 (referring to FIG. 4), with its gate voltage (the reference voltage Vbg) higher than the gate voltage (the voltage Vs) of the transistor T1, allows most of the current of the transistor T4 to flow through the transistor T2, turns off the transistor T14 in the driving stage 48, and completely turns on the transistor T8 to obtain the specific current Id from the node N4.

In the embodiment of the present invention in FIG. 5, at time t0, the voltage Vpg indicating the detection result of the detection circuit 45 also stays low as the regulated voltage V25 has not increased. Through the calculation by the NOR gate 54 (referring to FIG. 4), the voltage Vd1*b* is at the high level and consequently the voltage Vd1 is at the low level, so the current mirror 50 starts to operate and turns on the current Im, which flows into the node N4 according to the turned-on current Id of the transistor T8. Please notice that at this moment the current Id flowing into the node N4 is equal to the sum of the driving currents Ib and Im. That is, the secondary current Im turned on by the current mirror 50 and the driving current Ib of the base of the transistor Q1 flow into the node N4 together, and the driving current Ib is smaller than the current Id. As the current obtained by the operational amplifier 40 from the base of the transistor Q1 (referring to FIG. 3) becomes smaller, the transistor Q1 is not overdriven by excessive charging current Ic. It is mentioned in the prior art that when the regulator starts to operate, the NMOS transistor T8 in the driving stage has a high degree of current flowing. The conventional operational amplifier 20 does not have a current mirror to generate the secondary current, so the turned-on current Id0 of the transistor T8 is exactly equal to the driving current Ib0, which is large enough to overdrive and burn out the bipolar junction transistor. In contrast to the prior art, the present invention provides the additional current mirror 50 in the operational amplifier 40 to generate the secondary current Im, so that the driving current Ib will be smaller than the current Id even when the transistor T8 in the driving stage 48 has a higher degree of current flowing. Regarding the base of the transistor Q1 as a control end and the node N4 as a control node, although the degree of current flowing in the transistor T8 controls the current flowing from the node N4, the driving current Ib and the current Im flow into the node N4 together and the driving current Ib obtained by the operational amplifier 40 from the transistor Q1 will decrease. Therefore, the bipolar junction transistor Q1 in the regulator 38 of the present invention will not be overdriven and operates normally through the whole process of the establishment of the regulated voltage.

As shown in FIG. 5, driven by the driving current Id, the transistor Q1 provides the charging current Ic to affect the capacitive module 46, such as to charge the capacitor C1, to gradually pull up the voltage V25 of the node N0. While the voltage V25 increases, the driving voltage Vd of the output end Op of the operational amplifier 40 increases correspondingly. As mentioned before, when the regulated voltage V25 reaches a predetermined voltage V25*pg* (such as 90% of the regulated voltage in a steady state) at time t1, the detection circuit 45 (referring to FIG. 3) will pull up the voltage Vpg from a low level to a high level to notify the I/O circuit 36 and the core circuit 34 to reset and cooperate. Meanwhile, as the voltage Vpg changes, the voltages Vd1*b*, Vd1 change accordingly and the current mirror 50 stops providing the current Im for the node N4. Then, the operational amplifier 40, coordinating the amplifying circuit 49 and the driving stage 48, will dynamically adjust the driving status of the transistor Q1 (referring to FIG. 3) according to the feedback of the voltage Vs. Finally, the voltage Vs is locked at the level of the reference voltage Vbg and the regulated voltage V25 reaches the constant value in the steady state and stays at the voltage level V25*s* of the steady state. As shown in FIG. 5, the voltage level V25*s* of the steady state is equal to the voltage (1+R0/R1) Vbg.

In addition, referring to the circuit in FIG. 4, the voltage Vpg of the detection circuit 45 can control the current mirror 50 providing the secondary current Im Further, the detection circuit 45 in FIG. 3 can determine when the voltage Vpg has to be pulled from a low level to a high level (time t1 in FIG. 5) according to the charging time of another capacitor. For example, a standard current source and a standard capacitor (or an RC-circuit including resistors and capacitors) can be installed in the detection circuit 45. When the regulator 38 starts to operate at time t0, in the detection circuit 45 the standard current source starts to charge the standard capacitor (RC-circuit). After the voltage across the standard capacitor (RC-circuit) reaches a predetermined value, the detection circuit 45 pulls the voltage Vpg from the low level to the high level. That is, with properly designed values of the current of the standard current source and the capacitance of the standard capacitor (RC-circuit), the detection circuit 45 can "simulate", or estimate the property of the increase of the regulated voltage V25, so that when the regulated voltage V25 increasing from the low level at time t0 (referring to FIG. 5) reaches the voltage level of V25*pg*, the voltage across the standard capacitor in the detection circuit 45 reaches the predetermined value to trigger the detection circuit 45 at time t1 to pull the voltage Vpg from the low level to the high level.

In conclusion, when the regulator of the prior art starts to operate, it turns on the NMOS transistor in the driving stage of the operational amplifier with a specific turn-on current and causes the output end of the operational amplifier to obtain excessive current from the base of the bipolar junction transistor. Thus, the bipolar junction transistor is burned out and the regulator is not able to bias the core circuit normally. In contrast to the prior art, the present invention provides the secondary current by an additional current mirror in the operational amplifier at the beginning of the operation of the regulator. Even when the NMOS transistor in the driving stage has a high flowing current, the operational amplifier does not receive excessive driving current from the bipolar junction transistor. So, the bipolar junction transistor will not be burned out at the beginning of the establishment of the regulated voltage. After the regulated voltage is established, the operational amplifier of the present invention stops providing the secondary current, and drives the bipolar junction transistor with the amplifying circuit and the driving stage to bias the core circuit in the chip with the regulated voltage in the steady state. Thus, the normal operation is maintained.

Those skilled in the art will readily observe that numerous modifications and alterations of the device may be made while retaining the teachings of the invention. Accordingly, that above disclosure should be construed as limited only by the metes and bounds of the appended claims.

What is claimed is:

1. A regulator for providing a regulated voltage, the regulator comprising:

a charge circuit having a control end for conducting a driving current; the charge circuit capable of generating a charge current according to the driving current;

a capacitive module electrically connected to the charge circuit through electric charge provided by the charge current to establish the corresponding regulated voltage;

a driving circuit electrically connected to the charge circuit for controlling the current flowing from the control end; and a current mirror electrically connected to the control end for generating a secondary current flowing into the control end, wherein when the charge circuit generates the charge current and the regulated voltage is in a predetermined range, the current mirror will generate the secondary current to quickly reduce the charge current; and if the regulated voltage is outside the predetermined range, the current mirror will stop generating the secondary current.

2. The regulator of claim 1 wherein the charge circuit will correspondingly increase the charge current when the driving current increases.

3. The regulator of claim 1 wherein the driving circuit controls the current flowing from the control end to be at a constant level, and the driving current will decrease if the secondary current increases.

4. The regulator of claim 1 further comprising an amplifying circuit for generating an output voltage, wherein the amplifying circuit is electrically connected with the driving circuit and the current mirror.

5. The regulator of claim 4 wherein the driving circuit controls the current flowing from the control end according to the output voltage.

6. The regulator of claim 4 wherein the amplifying circuit generates the corresponding output voltage according to the regulated voltage.

7. The regulator of claim 4 wherein the amplifying circuit generates the corresponding output voltage according to a difference between the regulated voltage and a reference voltage.

8. The regulator of claim 4 wherein the current mirror adjusts the secondary current according to the output voltage.

9. The regulator of claim 1 further comprising a detection circuit for detecting whether the regulated voltage is in the predetermined range.

10. The regulator of claim 1 wherein the regulator generates a corresponding detection signal and the current mirror stops providing the secondary current after receiving the detection signal.

11. The regulator of claim 1 providing the regulated voltage for a chip installed on a circuit board; wherein the driving circuit and the current mirror are installed in the chip, and the charge circuit and the capacitive module are installed on the circuit board.

12. A method for providing a regulated voltage, the method comprising:

providing a charge circuit having a control end for conducting a driving current, the charge circuit capable of generating a charge current according to the driving current;

generating the regulated voltage according to the charge current; and generating a secondary current flowing into the control end through a current mirror electrically connected to the control end, wherein when the charge circuit generates the charge current and the regulated voltage is in a predetermined range, the current mirror will generate the secondary current to quickly reduce the charge current, and if the regulated voltage is outside the predetermined range, the current mirror will stop generating the secondary current.

13. A method for providing a regulated voltage, the method comprising:

providing a charge circuit having a control end for conducting a driving current, the charge circuit capable of generating a charge current according to the driving current;

electrically connecting a capacitive module to the charge circuit through electric charge provided by the charge current to establish the corresponding regulated voltage;

providing a driving circuit electrically connected to the charge circuit for controlling the current flowing from the control end; and generating a secondary current flowing into the control end through a current mirror electrically connected to the control end, wherein when the charge circuit generates the charge current and the regulated voltage is in a predetermined range, the current mirror will generate the secondary current to quickly reduce the charge current, and if the regulated voltage is outside the predetermined range, the current mirror will stop generating the secondary current.

* * * * *